US006299082B1

(12) United States Patent
Smith

(10) Patent No.: US 6,299,082 B1
(45) **Date of Patent: *Oct. 9, 2001**

(54) WASTE PROCESSING MACHINE

(76) Inventor: Leward N. Smith, Rte. 4, Box 160, Lake City, FL (US) 32024

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/071,237

(22) Filed: May 1, 1998

Related U.S. Application Data

(63) Continuation of application No. 08/637,233, filed on Apr. 24, 1996, now Pat. No. 5,863,003.
(60) Provisional application No. 60/001,538, filed on Jul. 26, 1995.

(51) Int. Cl.[7] ..... B02C 13/286
(52) U.S. Cl. ..... 241/186.35; 241/189.1; 241/200
(58) Field of Search ..... 241/186.35, 200, 241/185.1

(56) References Cited

U.S. PATENT DOCUMENTS

| | | | | |
|---|---|---|---|---|
| 190,675 | | 5/1877 | Gaines . | |
| 399,025 | * | 3/1889 | Evans | 241/186.35 |
| 589,236 | | 8/1897 | Williams . | |
| 604,283 | | 5/1898 | Albrecht . | |
| 1,043,831 | | 11/1912 | Heinkel et al. . | |
| 1,266,894 | | 5/1918 | Williams . | |
| 1,713,507 | | 5/1929 | Ammon . | |
| 1,752,290 | | 4/1930 | Ammon . | |
| 1,844,351 | | 2/1932 | Falkenstein . | |
| 1,889,129 | | 11/1932 | Nielsen . | |
| 2,026,790 | | 1/1936 | Mankoff | 83/11 |
| 2,128,194 | | 8/1938 | Sheldon | 83/11 |

(List continued on next page.)

FOREIGN PATENT DOCUMENTS

| | | | | |
|---|---|---|---|---|
| 3128559 | * | 1/1983 | (DE) | 241/186.35 |
| 59-39461 | | 3/1984 | (JP) . | |
| 61-245956 | | 11/1986 | (JP) . | |
| 62-259659 | | 11/1987 | (JP) . | |

OTHER PUBLICATIONS

Industrial Grinder, manufactured by Haybuster Brochure.
Maxigrind by Rexworks Brochure.

(List continued on next page.)

*Primary Examiner*—Mark Rosenbaum
(74) *Attorney, Agent, or Firm*—Bliss McGlynn & Nolan, P.C.

(57) ABSTRACT

A waste processing machine according to the invention is ideally suited for reducing virtually any products. The waste processing machine includes a rotor having multiple processing tools pivotally mounted thereon wherein each tool is adapted to self-limit the depth of the cut into the waste material. In addition, the pivotally mounted processing tools are staggered and spaced along the length of the rotor so that a limited number of tools will contact the waste product at any one point in time. Once the processing tool cuts or otherwise reduces the waste product to smaller bits of waste material, the bits are drawn out of the rotor system by screens having angled surfaces formed thereon.

3 Claims, 10 Drawing Sheets

U.S. PATENT DOCUMENTS

| | | | | |
|---|---|---|---|---|
| 2,212,482 | * | 8/1940 | Sheldon | 241/186.35 |
| 2,244,577 | | 6/1941 | Schreiber | 83/11 |
| 2,318,219 | | 5/1943 | Harris | 83/11 |
| 2,392,958 | | 1/1946 | Tice | 241/55 |
| 2,663,505 | | 12/1953 | Sennholtz | 241/197 |
| 2,710,635 | | 6/1955 | Alexander | 144/162 |
| 2,863,476 | | 12/1958 | Clark | 144/172 |
| 2,864,420 | | 12/1958 | Schmidt | 146/106 |
| 3,175,830 | * | 3/1965 | Lepp | 241/186.35 |
| 3,208,491 | * | 9/1965 | Bliss | 241/186.35 |
| 3,254,687 | | 6/1966 | Tertyshnikov | 146/79 |
| 3,367,585 | | 2/1968 | Ratkowski | 241/197 |
| 3,436,028 | | 4/1969 | Koehnen et al. | 241/186 |
| 3,509,924 | | 5/1970 | Newhouse, Jr. | 146/7.01 |
| 3,642,214 | | 2/1972 | Blackwell, Jr. | 241/191 |
| 3,844,494 | | 10/1974 | Hightower | 241/197 |
| 3,907,016 | | 9/1975 | Nicholson et al. | 144/172 |
| 4,074,594 | | 2/1978 | Dall et al. | 76/101 |
| 4,077,450 | | 3/1978 | Ackerman | 144/172 |
| 4,117,985 | | 10/1978 | Lazareck | 241/197 |
| 4,129,260 | | 12/1978 | Baker | 241/46 |
| 4,146,184 | | 3/1979 | Whitney | 241/73 |
| 4,162,769 | | 7/1979 | Lapointe | 241/68 |
| 4,168,035 | | 9/1979 | Palm et al. | 241/81 |
| 4,375,233 | | 3/1983 | Rossmann et al. . | |
| 4,423,646 | | 1/1984 | Bernhardt . | |
| 4,466,265 | | 8/1984 | Wessel . | |
| 4,504,019 | | 3/1985 | Newell et al. | 241/73 |
| 4,702,424 | | 10/1987 | Widlak | 241/101.7 |
| 4,717,083 | | 1/1988 | Quast et al. | 241/197 |
| 4,850,406 | | 7/1989 | Krautzberger | 144/230 |
| 4,872,500 | | 10/1989 | Duffey et al. | 164/34 |
| 4,905,751 | | 3/1990 | Dupin . | |
| 4,915,310 | | 4/1990 | Stelk | 241/197 |
| 4,917,314 | | 4/1990 | Manschwetus | 241/194 |
| 4,922,977 | | 5/1990 | Colton et al. | 144/230 |
| 4,967,969 | | 11/1990 | Griffith, III | 241/93 |
| 4,982,904 | | 1/1991 | Greiner | 241/73 |
| 5,027,878 | | 7/1991 | Revankar et al. . | |
| 5,042,727 | | 8/1991 | Plante | 241/101.7 |
| 5,044,567 | | 9/1991 | Hte et al. | 241/73 |
| 5,078,328 | | 1/1992 | Willingham | 241/101.7 |
| 5,114,085 | | 5/1992 | Inui | 241/195 |
| 5,169,077 | | 12/1992 | Stelk . | |
| 5,205,496 | | 4/1993 | O'Donnell et al. | 241/34 |
| 5,209,278 | | 5/1993 | Carpenter et al. | 144/230 |
| 5,238,046 | | 8/1993 | Guerard . | |
| 5,285,974 | | 2/1994 | Cesarini | 241/94 |
| 5,337,801 | | 8/1994 | Materkowski . | |
| 5,377,919 | | 1/1995 | Rogers et al. | 241/189.2 |
| 5,413,286 | | 5/1995 | Bateman | 241/190 |
| 5,474,239 | | 12/1995 | Williams, Jr. et al. | 241/73 |
| 5,526,988 | | 6/1996 | Rine | 241/23 |

OTHER PUBLICATIONS

The Beast from Bandit Industries, Inc. Brochure.
Bandit Industries, Inc., Construction Journals Brochure.
The Beast, Convert Unwanted Wood Into A Saleable Product Quickly And Economically With The Bandit Beast Combination Chippers And Grinders, Sep. 1994.
Bandit's Beast Maintains Nature's Beauty, Construction Equipment Guide, Jun. 1, 1994.
Bandit Industries, Inc., Timber West, Nov. 1993.
Forest Products Equipment Article, Aug. 1994.
The Beast Recyclers from Bandit Industries . . . with Big Appetites for Waste Brochure.
The Beach Model 15–H, Bandit Industries, Inc. Brochure.
How to chop yard waste costs!, Farmhand Brochure.
Megagrind by Rexwords 800, Most Productive Portable Materials Processing System Available Brochure.
The Model 15 Beast, MSW Management, Mar./Apr. 1994.
Want to Lower the Cost of Breaking Down Yard and Other Landfill Waste? Try The Beast From Bandit, Resource Recycling, Nov. 1994.
Turn Your Green Waste Into Green Dollars, Bandit Industries, Inc., Sportsturf, Jun. 1994.
"Product Release" For The New Model 15–H Beast Recycler Offered By Bandit Industries, Waste Handling Equipment New, Jun. 1994.
For Your Chipping and Grinding Needs, Bandit Industries, Inc., Forest Products Equipment, Aug. 1994.

* cited by examiner 10
16
170
54
140
142
144
150
52
146
166
164
148
56
A
60
62
50
162
46
58
44
42
40
28
26
14
24
20
22
12
32
18
160

FIG 4
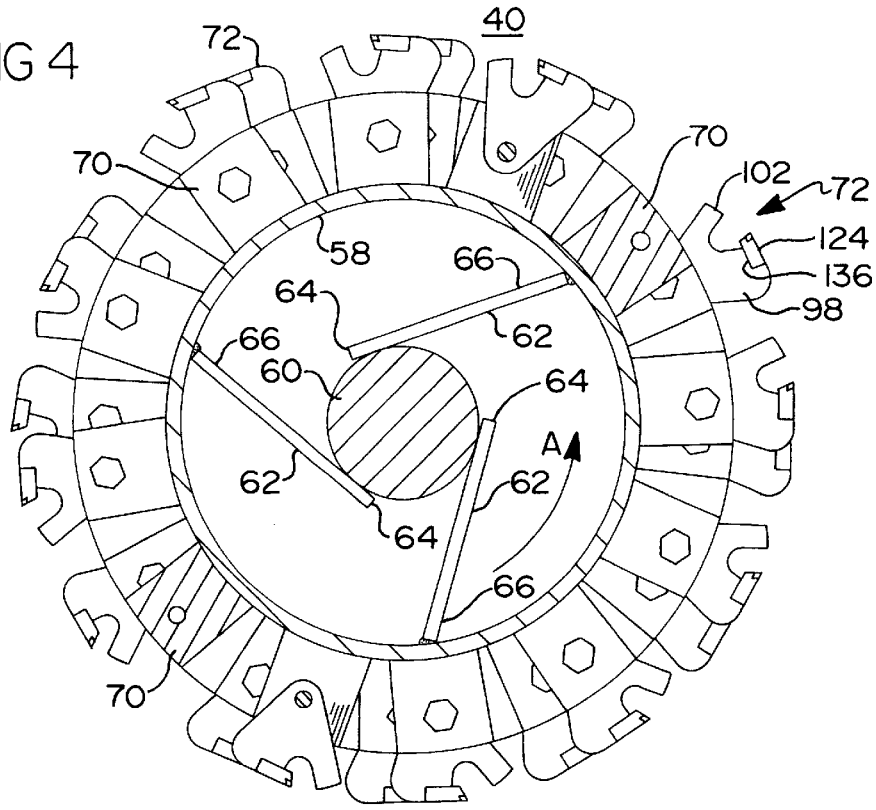
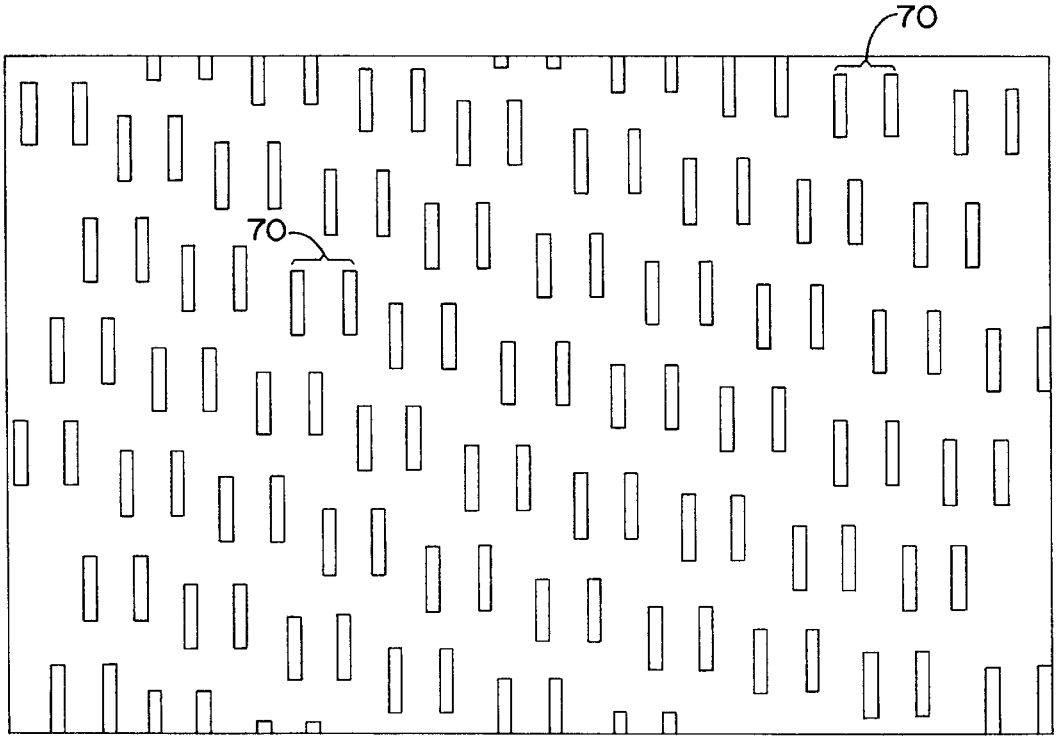
FIG 11

40
60
62
64
66
70
72
74
76
78
80
82
84
86
88
90
92
58
110
7

WASTE PROCESSING MACHINE

This application claims the benefit of U.S. provisional application Ser. No. 60/001,538 filed Jul. 26, 1995 and Con of Ser. No. 08/637,333 Apr. 24, 1996 U.S. Pat. No. 5,863,003.

BACKGROUND OF THE INVENTION

1. Field of the Invention

This invention relates to a waste processing machine and, more specifically, to a waste processing machine incorporating a rotor having multiple cutting or shredding tools pivotally mounted thereon.

2. Description of the Related Art

A variety of machines have been developed to chip, cut, grind, or otherwise reduce waste products. Currently, four types of equipment are generally used for this purpose: chippers (disk and drum types), hammer mills, hogs, and shredders.

Chippers are generally constructed around a rotating disk or drum and a plurality of blades are mounted to the disk or drum. As the drum rotates, the blades sheer the product to be reduced into chips. Chippers are ideally suited to chip logs and trees as well as small brush. A significant disadvantage for chippers is that they require reasonably "clean" wood in order for the chipper knives to remain sharp. Any foreign materials such as nails, spikes, rocks, and sand will quickly dull the knife cutting edge. For this reason, chippers are not suited for reducing wood waste products such as pallets, tree stumps, and other waste products in which wood, dirt, and other foreign objects would be found.

Hammer mills are generally constructed around a rotating shaft that has a plurality of disks provided thereon. A plurality of free-swinging hammers are typically attached to the periphery of each disk. With this structure, a portion of the kinetic energy stored in the rotating disks is transferred to the wood products through the rotating hammers. The hammers strike the product in order to reduce it. A hammer mill will break up pallets, paper products, construction materials, and small tree branches. Because the swinging hammers do not use a sharp edge to cut the waste material, the hammer mill is more suited for processing "dirty" waste products. A hammer mill also has the advantage that the rotatable hammers will recoil backwardly if the hammer cannot break the material on impact. One significant problem with hammer mills is the wear of the hammers over a relatively short period of operation in reducing "dirty" products which include materials such as nails, dirt, sand, metal, and the like.

Hogs are similar to hammer mills except the hammers provided on the hogs are rigidly secured to the periphery of the rotating disks. The hog hammer assembly suffers from the disadvantage that the hammers directly mounted to the rotating disk will often be damaged when the hog hammers strike a non-grindable object.

Chippers, hammer mills, and hogs all operate at a high speed of rotation. Shredders operate at a much slower speed of rotation and therefore are more suited for processing metals and rubber products.

The waste processors known in the prior art suffer from several problems. First, none of the waste processors known in the prior art can adequately process dirty material without resulting in undue wear on the machine or frequent clogging or jamming of the machine. Another significant problem for the known processing machine is the time involved in changing the processing tools, it takes several hours to change the processing tools such as cutting knives or hammers for these machines. When this problem is coupled with the unacceptably fast wear of the processing tool, then the operating time of the machine is dramatically reduced creating an unacceptably inefficient machine.

SUMMARY OF THE INVENTION

The waste processing machine according to the invention overcomes the problems of the prior art by incorporating means which can reduce a large variety of dirty products, including product contaminated with non-grindables. In addition, the cutting tools are adapted to have a long-wear life as compared to the prior art and can be quickly changed in the event that the tool fails or is worn out.

The invention centers around a rotor assembly which is provided inside a waste processing or waste reducing machine. The rotor assembly is rotationally mounted inside a housing. The rotor assembly has multiple processing tools mounted to the external surface of the rotor. Preferably, the processing tools are staggered about the periphery so that a small, limited number of processing tools contact a line passing parallel to the axis of rotation of the rotor at any one point in time. Preferably, the processing tools are provided on the surface in multiple, helical patterns sweeping around at least part of the rotor. Depending upon the sweep of the helical pattern, two or more cutting tools might be aligned to strike the same point on the line parallel to the axis of rotation of the rotor during each revolution of the rotor.

The processing tools are adapted to be modified for a variety of different uses and are easily repaired or replaced. Preferably, each processing tool is pivotally mounted to a pair of upstanding arms provided on the exterior surface of the rotor. The processing tool is easily adapted for a wide variety of applications. For example, cutting, shredding, or chipping tools or a combination thereof can be mounted to the processing tool, depending upon the particular waste reducing or processing application.

Preferably, each processing tool is C-shaped wherein the leading arm of the C-shape operates as a depth-limiting guide for the cutting, chipping, or shredding tool provided on the other of the two arms. Through the combination of staggering the processing tools about the periphery of the rotor and limiting the depth of cut for each tool, the waste reducing system according to the invention can accommodate dirty waste products without jamming or clogging. More importantly, the anvil, which is typically incorporated in waste reducing systems in the prior art, can be eliminated because the force exerted on the waste product at any one point in time is relatively small. In the preferred embodiment, there is no anvil incorporated. The waste product is supported solely by a conveyor positioned a short distance away from the rotor assembly. By the elimination of the anvil, clogging problems have been largely eliminated.

Another aspect of the invention is a unique structure for mounting the rotor tube to a support shaft. A jig is provided having supports extending radially outwardly therefrom wherein the end surfaces of the supports are tapered. The jig is inserted so that the tapered end of the braces contacts the interior surface of the tube and effectively centers itself on the tube interior. Next, a shaft is inserted into the jig and clamped thereon. Finally, multiple brace members are welded to the interior of the tube and the shaft. Preferably, the braces are mounted tangentially to the surface of the tube. With this structure, the braces act as a spring to absorb unexpected shock experienced by the rotor assembly during the waste reducing process.

The invention also centers around means for providing a secondary waste reducing or cutting operation. A basin is provided immediately below the rotor for collecting the pieces of material being reduced. An anvil is provided at the top of the basin immediately adjacent the rotor assembly. Augers are provided in the basin to urge the waste material upwardly toward the anvil and rotor assembly. As the level of material builds in the basin, eventually, the material will be brought into contact with the rotor, and the anvil and will be further reduced.

Another element of the invention is a novel screen provided at the discharge of the rotor assembly. Typically, screens are used to provide a limit on the size of waste product exiting the system. The screen according to the invention provides the additional function of disrupting the boundary layer surrounding the rotor and stripping any entrapped material from the boundary layer. The screen accomplishes this function by creating an angled surface on the surfaces of the screen which extend parallel to the longitudinal axis of the rotor. Preferably, the angle is approximately 32° from the radius of the rotor.

BRIEF DESCRIPTION OF THE DRAWINGS

FIG. 4 is a sectional view of the second embodiment of the rotor taken along lines 4—4 of FIG. 3;

FIG. 11 is a schematic representation of the tool pattern on the surface of the rotor assembly of FIG. 3;

DETAILED DESCRIPTION OF THE PREFERRED EMBODIMENTS

Figure 1:
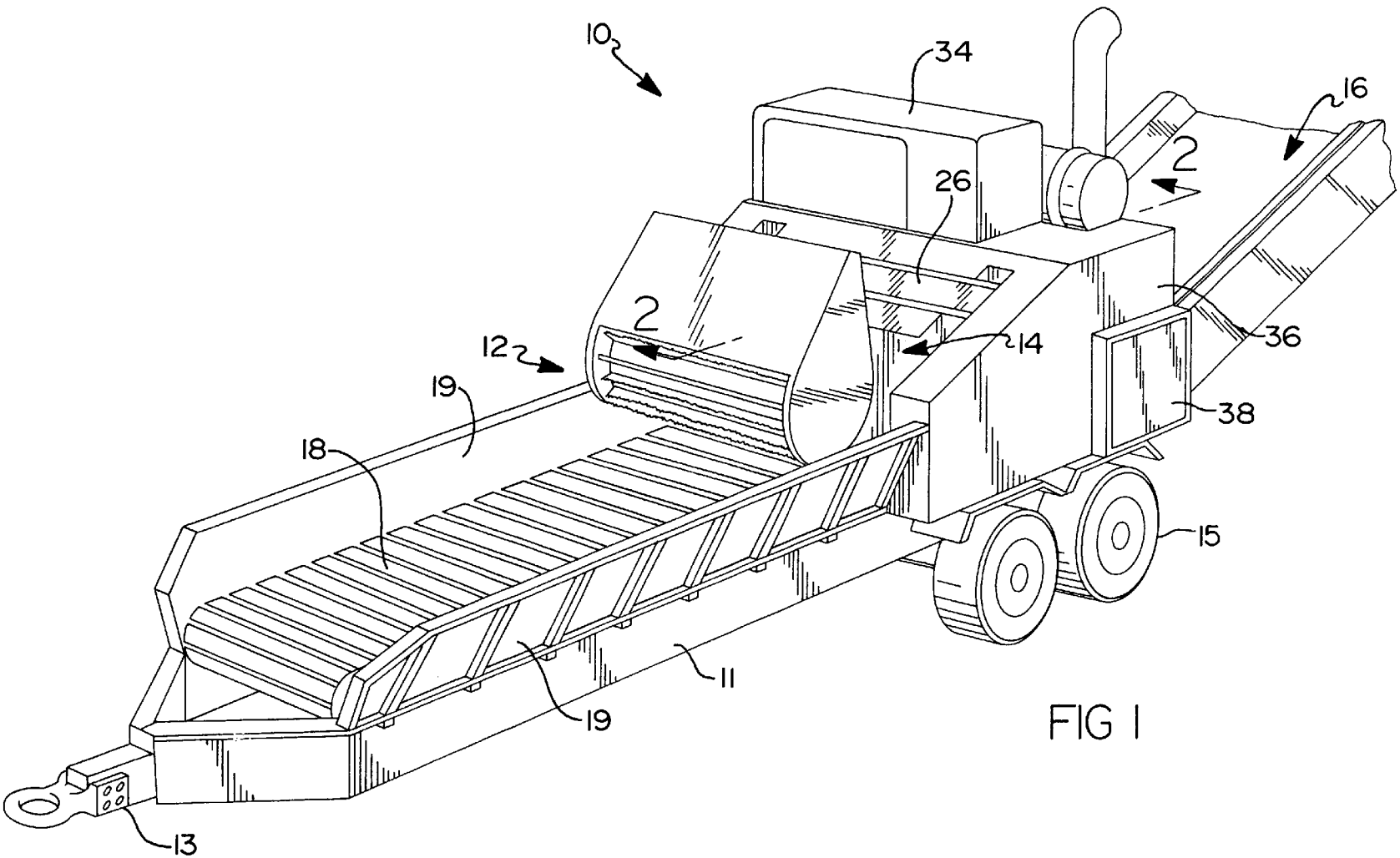
FIG. 1 is a perspective view of a waste processing machine according to the invention.
Figure 2:
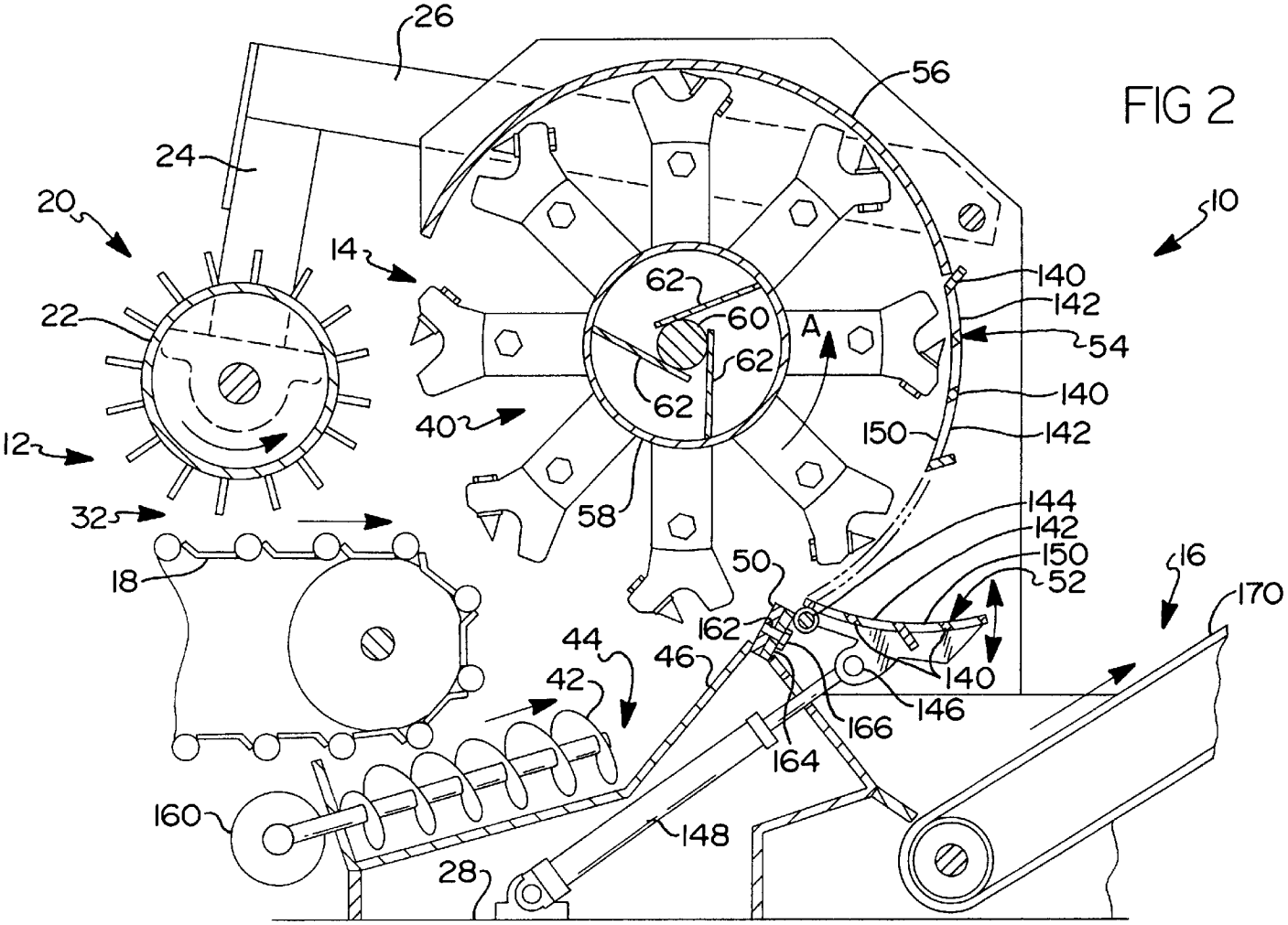
FIG. 2 is a partial, sectional, side elevational view of a portion of the waste processing machine taken along lines 2—2 of FIG. 1 showing the first embodiment of the rotor assembly.

Referring now to the drawings, FIGS. 1 and 2 illustrate a waste processing machine 10 comprising three major functional systems: an infeed system 12, a cutting system 14, and a discharge system 16. Waste material enters the waste processor 10 through the infeed system 12 where it is directed to the cutting system 14. The cutting system cuts the waste and directs it to the discharge system 16 where the waste is expelled from the processor 10.

Preferably, the waste processing machine 10 is supported on a trailer framework 11 having a tongue mount 13 provided at the front thereof and wheels 15 near the rear of the framework 11. With this structure, the infeed system 12 and cutting system 14 can be transported together while the discharge system 16 would be transported separately therefrom.

The infeed system 12 and discharge system 16 are well known in the art and will only be described generally. The systems are described in detail in U.S. Pat. No. 5,372,316 issued Dec. 13, 1994 and U.S. Pat. No. 5,362,004 issued Nov. 8, 1994. The infeed system 12 comprises an infeed conveyor 18 and a feed wheel assembly 20. Opposed side walls 19 are provided on opposite sides of the conveyor to contain the waste product. The feed wheel assembly 20 comprises a feed wheel 22 which is rotatably mounted to the lower end of a vertical support arm 24. A conventional hydraulic motor is provided to rotate the feed wheel. The upper end of the vertical support arm is mounted to one end of a horizontal support arm 26. The other end of the horizontal support arm 26 is pivotally mounted to the support frame 28 for the waste processing machine 10. At least one hydraulic cylinder 30 is provided between the vertical support arm 24 and the support frame 28 for altering the position of the feed wheel 22 with respect to the conveyor 18. Specifically, the hydraulic cylinder 30 is adapted to raise and lower the feed wheel 22 with respect to the conveyor 18. The space between the conveyor and feed wheel is generally defined as the inlet opening 32.

In operation, waste material is placed on the feed conveyor 18 which moves the material into contact with the feed wheel 22 which in turn rolls the material through the inlet opening 32 into contact with the cutting system 14. Preferably, the feed wheel 22 is freely pivotally with respect to the support frame 28 during operation of the machine so that as large pieces of waste material are drawn into the inlet opening, the feed wheel 22 and support arms 24, 26 will pivot upwardly about the pivot point thereby enlarging the inlet opening 32 to accommodate the waste product. As the large waste product passes through the inlet opening 32 into the cutting system 14, gravity will draw the feed wheel 22 back down toward the conveyor 18. The hydraulic cylinders 30 are adapted to permit an operator to raise the feed wheel 22 with respect to the conveyor to inspect the cutting system 14 or to provide access for large waste products. In addition, the cylinders 30 provide for automatic leveling of the feed wheel if it begins to bind as a result of non-parallel alignment of the feed wheel axis of rotation with the conveyor axis of rotation.

The cutting system 14 centers around a rotor assembly 40 which is rotatably mounted to the support frame 28. The rotor assembly 40 is provided inside a housing 36. A power source 34 is provided on top of the housing 36. The power source provides all necessary power for the infeed system 12, cutting system 14, and discharge system 16. Examples of suitable power sources include an electric motor, a gas engine, or preferably, a diesel engine. A control panel 38 is provided on the side of the housing 36. All necessary controls for the power source 34 and associated hydraulic and electrical systems are accessible at the control panel 38.

The primary element of the cutting system is the rotor assembly 40. However, the cutting system further comprises a plurality of regrind augers 42 positioned beneath the rotor 40 in a basin 44 defined by the bottom wall 46 of the housing 36. The bottom wall 46 extends upwardly to a secondary anvil 50 positioned at the terminal end of the wall 46. Immediately adjacent the secondary anvil 50 is a movable concave screen 52 and a fixed concave screen 54. Above the screens is an arcuate upper wall 56 which partially surrounds the body of the rotor 40 and terminates adjacent the feed wheel 22 and inlet opening 32.

The cutting system 14 and rotor assembly 40 are described in combination with the illustrated infeed system 12 and discharge system 16. It should be understood that any suitable infeed system and discharge system can be used with the rotor assembly 40 according to the invention. Also, depending upon the application, the rotor assembly may not require one or both of the infeed system 12 or discharge system 16.

The first embodiment of the rotor assembly 40 is seen in FIG. 2. FIGS. 3–10 show different details regarding the rotor assembly and related components. However, the rotor assembly depicted in these figures is the second embodiment of the rotor assembly seen in FIG. 16. The two embodiments of the rotor assemblies are functionally identical and differ mainly in the number and arrangement of cutting tool assemblies.

Figure 3:
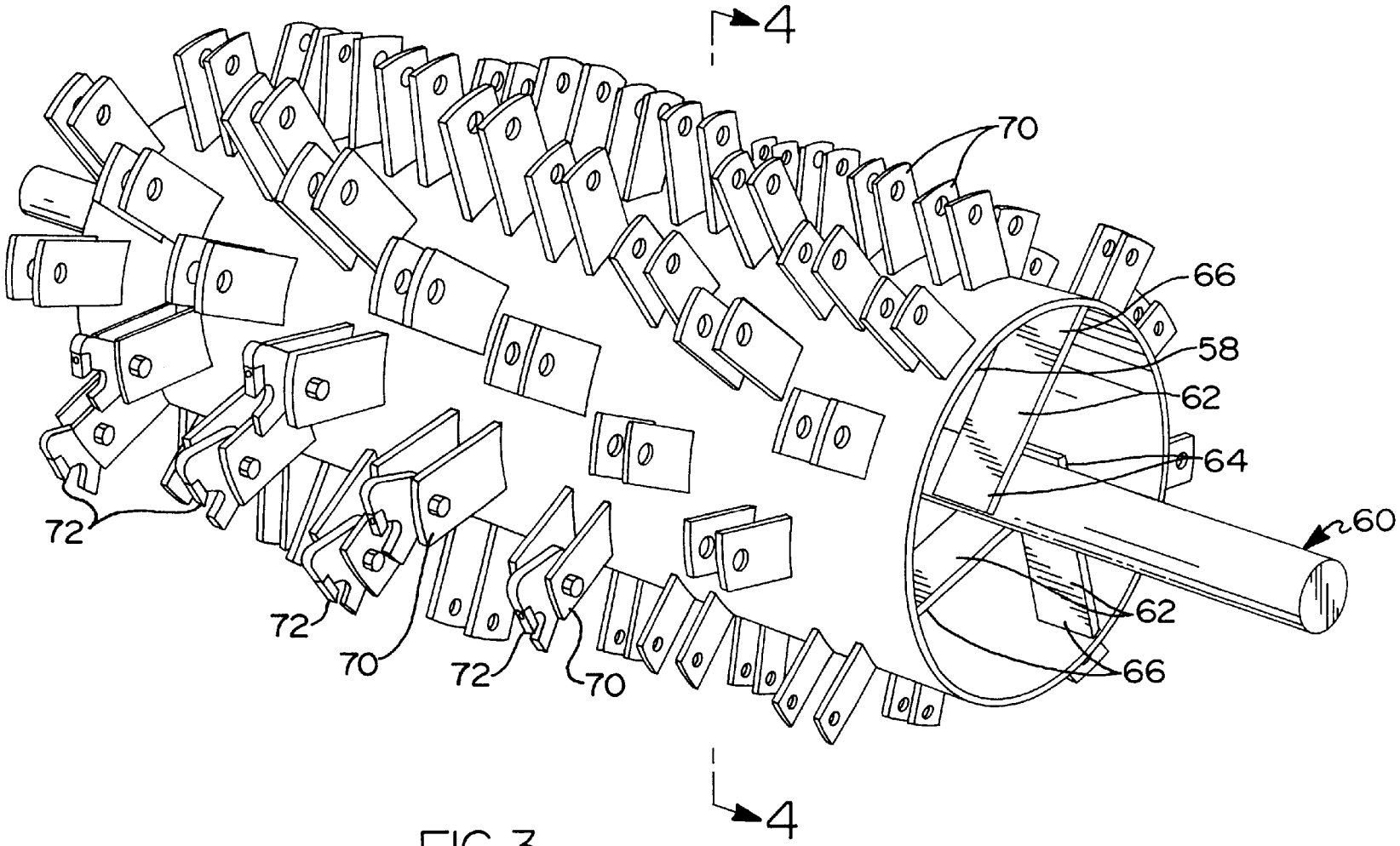
FIG. 3 is a perspective view of the second embodiment of the rotor assembly of FIG. 16.

Referring to FIGS. 3 and 4, the rotor assembly comprises a tube 58 having a longitudinal axis. The tube 52 is mounted to a coaxially disposed shaft 60 by multiple braces 62 extending tangentially from the outer surface of the shaft 60 to the inner surface of the tube 58. Preferably, each brace 62 is an elongated plate-like member having a proximal end 64 and a distal end 66. The three braces are preferably positioned near each end of the tube 58, and the tube is adapted by the present construction to rotate about the longitudinal axis of the shaft 60 in the direction of arrow A. Each brace 62 is mounted so that its proximal end 64 is fixed tangentially to the shaft 60 by welding, and the distal end is similarly secured by welding to the inner surface of the tube 58.

Figure 16:
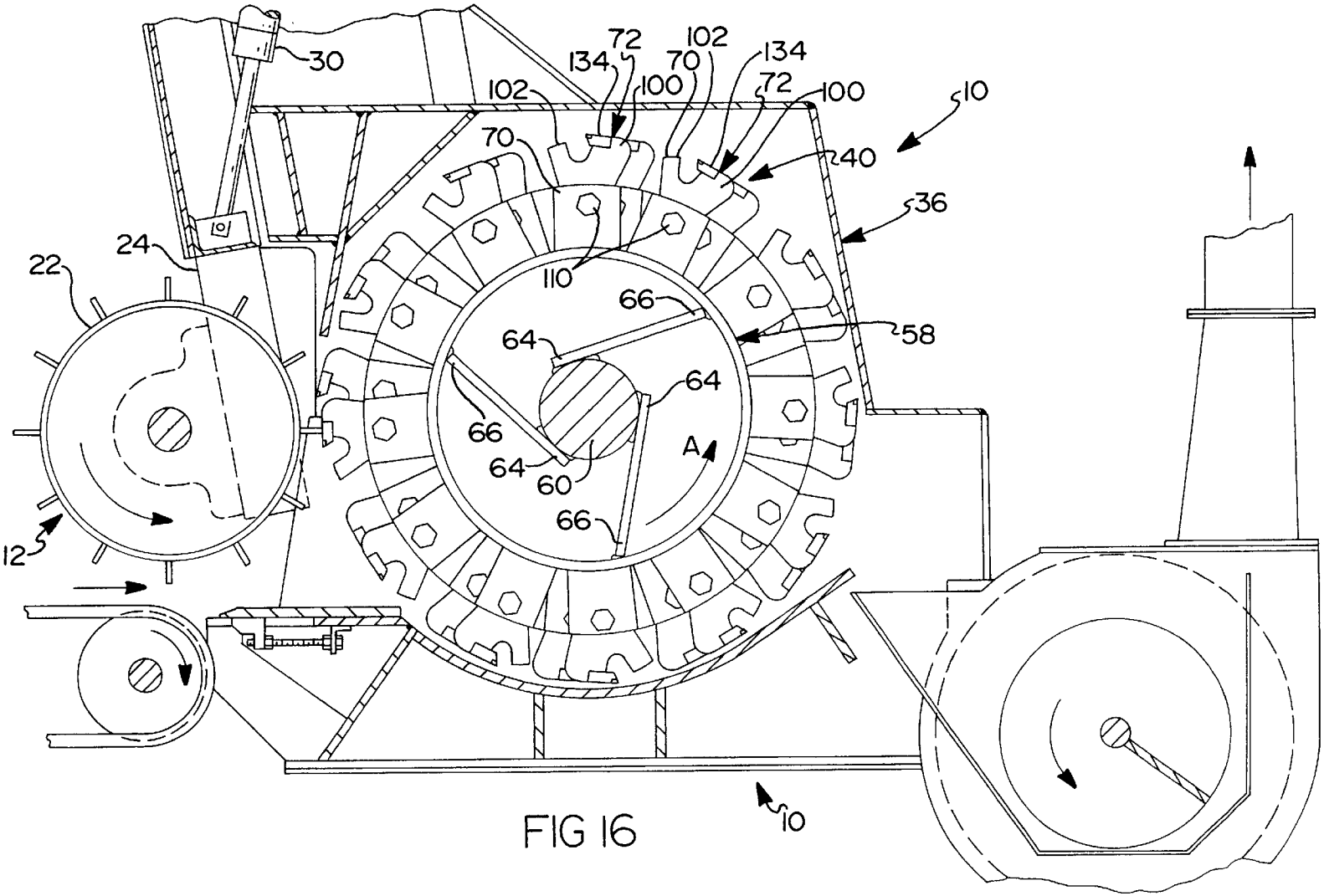
FIG. 16 is a side elevational view of a second embodiment of a waste processor according to the invention showing the second embodiment of the rotor assembly.

When mounted in a waste processor 10, as seen in FIGS. 2 and 16, the shaft 60 is rotatably supported at its ends, as will be described further below, to permit the rotation of the shaft 60 and the tube 58 about their coaxially aligned longitudinal axes. The power source 34 is connected to the shaft in a well-known manner and adapted to turn the shaft 60 and tube 58.

The outer surface of the tube 58 has a plurality of spaced arm pairs 70 mounted thereto, preferably by welding. Each arm pair 70 rotatably mounts a processing tool 72 which cuts, chops, chips, or otherwise reduces the waste material presented to the rotor assembly 40 by the infeed system 12. Ideally, the pairs of arms 70 will be mounted so that in one rotation of the rotor, every point on an imaginary axial line segment positioned adjacent to the rotor will be contacted by the cutting tools 72 mounted to the rotor.

Figures 5, 6, 7:
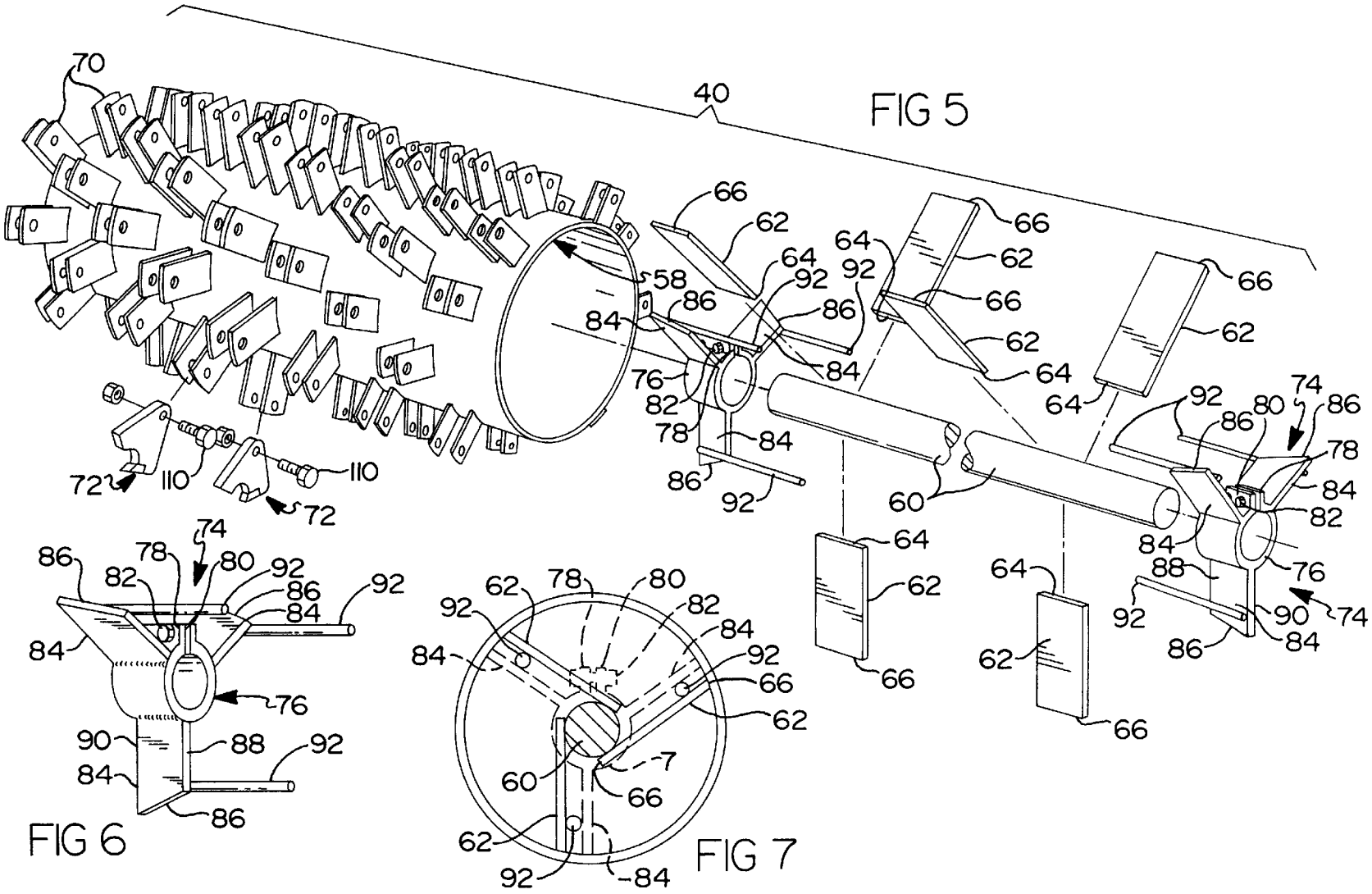
FIG. 5 is an exploded view of the second embodiment of the rotor assembly of FIG. 3, including the assembly jig used to assembly the rotor.
FIG. 6 is a perspective view of the assembly jig of FIG. 5.
FIG. 7 is a side elevational view of a partially assembled rotor of FIG. 3 using the assembly jig of FIG. 6.

FIGS. 5–7 illustrate the novel fabrication of the rotor assembly 40. A centering jig 74 is provided with a hub comprising a split collar 76 terminating in a pair of opposing flanges 78, 80. The flanges 78, 80 are adapted to connect to each other by a fastener 82 such as a conventional bolt and nut. The split collar 76 has an inner diameter, with the flanges unconnected, slightly larger than the outer diameter of the rotor shaft 60. Three centering arms 84 spaced equally from each other extend radially outwardly from the split collar 76. Each centering arm 84 has a tapered end 86 creating a shorter radial edge 88 and a longer radial edge 90. The radius of the split collar 76 from its longitudinal axis along the shorter radial edge 88 will typically be less than the inner radius of the tube 58. Conversely, the radius of the split collar 76 along the longer radial edge will be greater than the radius of the tube 58. A guide bar 92 is preferably mounted near the tapered end 86 of each centering arm 84 and extends laterally from the shorter radial edge 88.

To fabricate the rotor assembly 40, a jig 74 is inserted, shorter, radial edge first, in each end of the tube 58 until the tapered end 86 of each centering arm 84 contacts the inner surface of the tube at the annular end thereof. The shaft 60 is fed through the split collar 76 of the two jigs 74, and the fasteners 82 are tightened to secure the shaft 60 to each jig 74. As the fasteners 82 are tightened, the flanges 78, 80 of the collar 76 are drawn together so that the shaft 60 is compressed within the collar. Coincidentally, the longitudinal axis of the shaft 60 is coaxially aligned with the longitudinal axis of the tube 58. With this structure, the jigs 74 cooperate to provide quick and easy alignment of the shaft 60 with respect to the tube 58.

In addition to aligning the shaft 60 with respect to the tube 58, the jig 74 further aids in positioning of the braces 62. The outer end of each brace 62 is positioned so that it abuts one of the guide bars 92 extending from the jig 74, and then the inner end of the brace 62 is securely fixed to the shaft, preferably by welding. As noted above, the inner end is mounted so that it extends tangentially from the shaft. Next, the outer end of the brace 62 is secured to the inside surface of the tube 58 by conventional means, preferably by welding. With this mounting structure, each brace extends tangentially from the shaft to the tube, rather than radially.

The tangential mounting of the braces 62 with respect to the shaft 60 permits the braces to absorb the large loads associated with an unbreakable object or "non-grindable" material impeding rotation of a processing tool 72 or arm pair 70. For example, as the rotor assembly 40 rotates, the processing tool 72 or arm pair 70 might impact a non-grindable object. The impact force is transferred through the arm pairs 70 to the tube 58 and tends to deflect the tube 58. The deflection of the tube 58 is transferred to the outer end of an adjacent brace 62 which generates a bending moment in the brace about the tangential point of contact with the shaft 60. Inherent resiliency of the brace 62 absorbs and resists the bending moment, resulting in its bending in response to the force to absorb the force and then returning to its original position. In essence, the braces 62 perform a function similar to a spring.

One advantage of the rotor assembly 40 according to the invention is that its dimensions are almost infinitely scalable, unlike prior art rotor assemblies. By selecting a tube of the desired diameter, a rotor of any diameter can be formed by using appropriately sized jigs and braces. Furthermore, the unique tube, braces and shaft arrangement result in a rotor assembly of relatively low mass and inertia for a given diameter as compared to the prior art. The combination of the scalability and relatively low mass and resulting low inertia permits the rotor assembly 40 to be manufactured in diameters that are substantially larger than previous waste processors at substantially lower cost and weight. Advantageously, as the diameter of the waste processor is increased, so does the mouth or operational area of the rotor assembly 40. The rotor assembly 40 can be scaled from a relatively small size of a few feet for processing small items such as limbs, pallets, etc., up to tens of feet for processing whole trees and other large materials and still have a sufficiently low mass and inertia that it can be rotated by a practical power supply.

Figure 13:
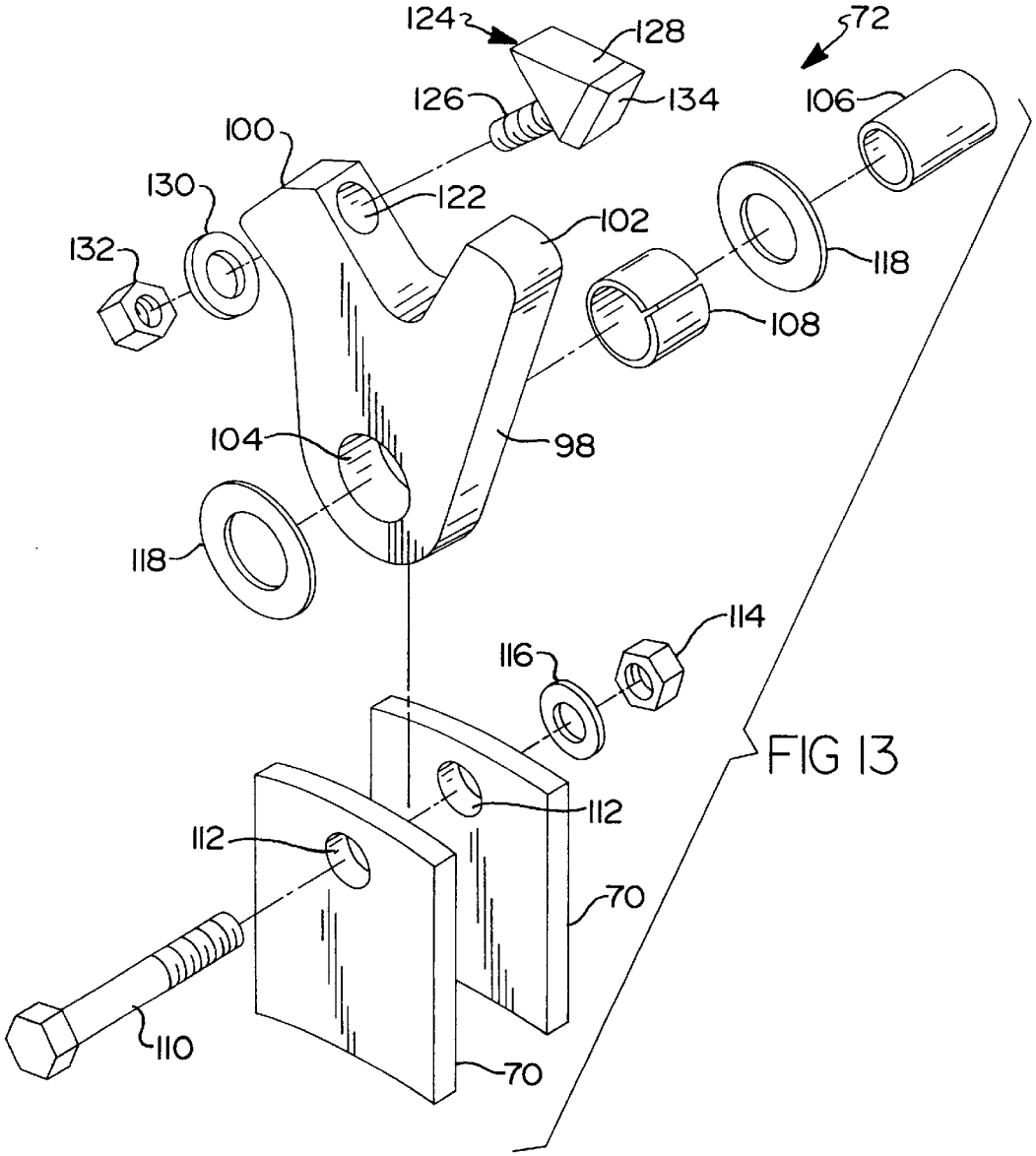
FIG. 13 is an exploded view of a second embodiment of the processing tool assembly.

FIG. 13 illustrates the preferred embodiment of a cutting tool assembly 72 according to the invention. The processing tool 72 comprises a body 98 which is substantially C-shaped in profile having a bight portion and first and second arms 100, 102, respectively. A bearing aperture 104 is provided at the base of the tool body 98. The aperture 104 is adapted to receive the inner sleeve 106, the outer sleeve 108 of a conventional bearing assembly along with the shaft of a conventional bolt 110. The bolt 110 extends through apertures 112 provided in the arms 70 and through the bearing assembly and tool body 98 for pivotally mounting the tool body 98 to the arms 70. A conventional nut 114 and washer 116 are provided for fastening the tool 72 to the arms 70. Spacer members 118 are provided between the inside surface of the arms 70 and the side surface of the tool body 98. With this construction, the tool body 98 is pivotally mounted to the arms 70 which are in turn secured to the exterior surface of the rotor tube 58.

The tool body 98 is adapted to quickly and easily receive one of several different processing tools. A cutting tool element aperture 122 extends through the first arm 100 of the tool body 98. The aperture 122 is adapted to receive a portion of a processing tool element 124. The first embodiment of the processing tool element comprises a shaft 126 which is threaded on one end thereof and has a head 128 provided on the other end thereof. The shaft 126 extends through the aperture 122 and receives a washer 130 and nut 132 on the threaded end. With the tool element 124 mounted in this manner, the head 128 projects into the gap defined by the two arms 100, 102. Preferably, the head 128 and shaft 126 are formed from steel, and a carburized cutting tip 134 is provided at the end of the head 128.

Figure 8:
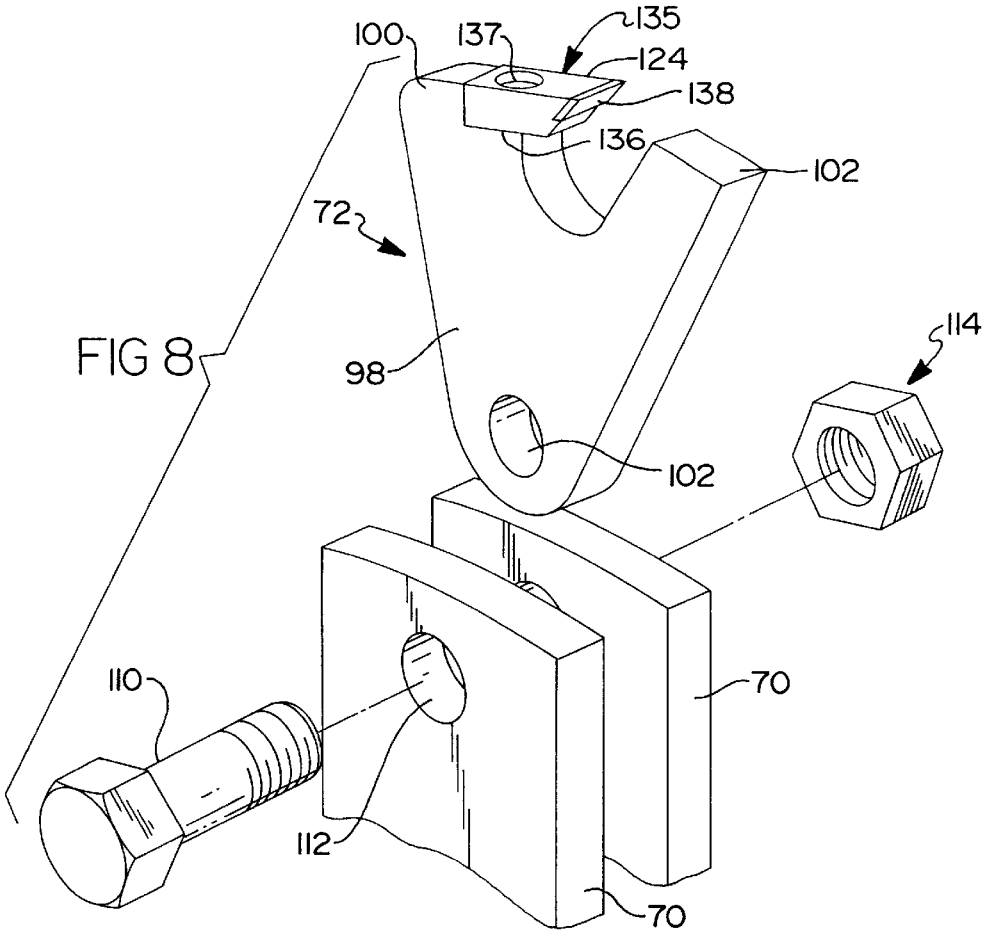
FIG. 8 is an exploded view of a first embodiment of a processing tool.

A second embodiment of the processing tool is seen in FIG. 8. In this embodiment, the processing tool element comprises a chipping knife 135 which is received in a notch 136 provided at the terminal end of the first arm 100. Both the chipping knife 135 and the first arm 100 have a threaded aperture 137 provided therein. A fastener, such as a threaded cap bolt (not shown), is received within the threaded aperture 102 of the chipping knife 135 and the threaded aperture of the first arm 100 to secure the chipping knife to the tool body 98. Preferably, the chipping knife 135 includes a carburized tip 138 provided at the terminal end thereof to provide enhanced performance and durability of the knife 135.

Figure 9:
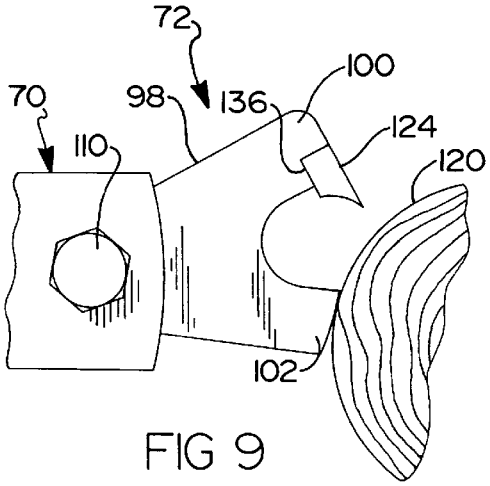
FIG. 9 is a side elevational view of the processing tool of FIG. 8 prior to contacting a log.
Figure 10:
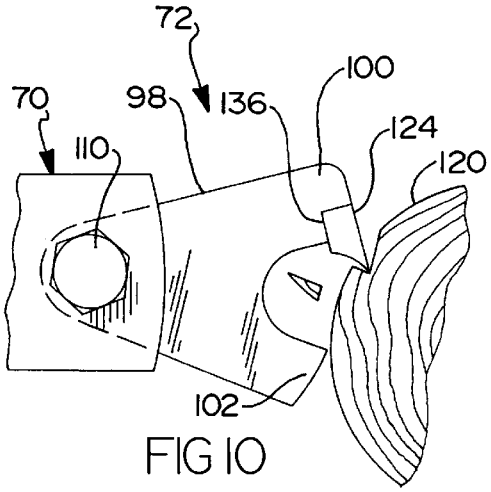
FIG. 10 is a side elevational view of the processing tool of FIG. 8 in contact with a log.
Figure 14:
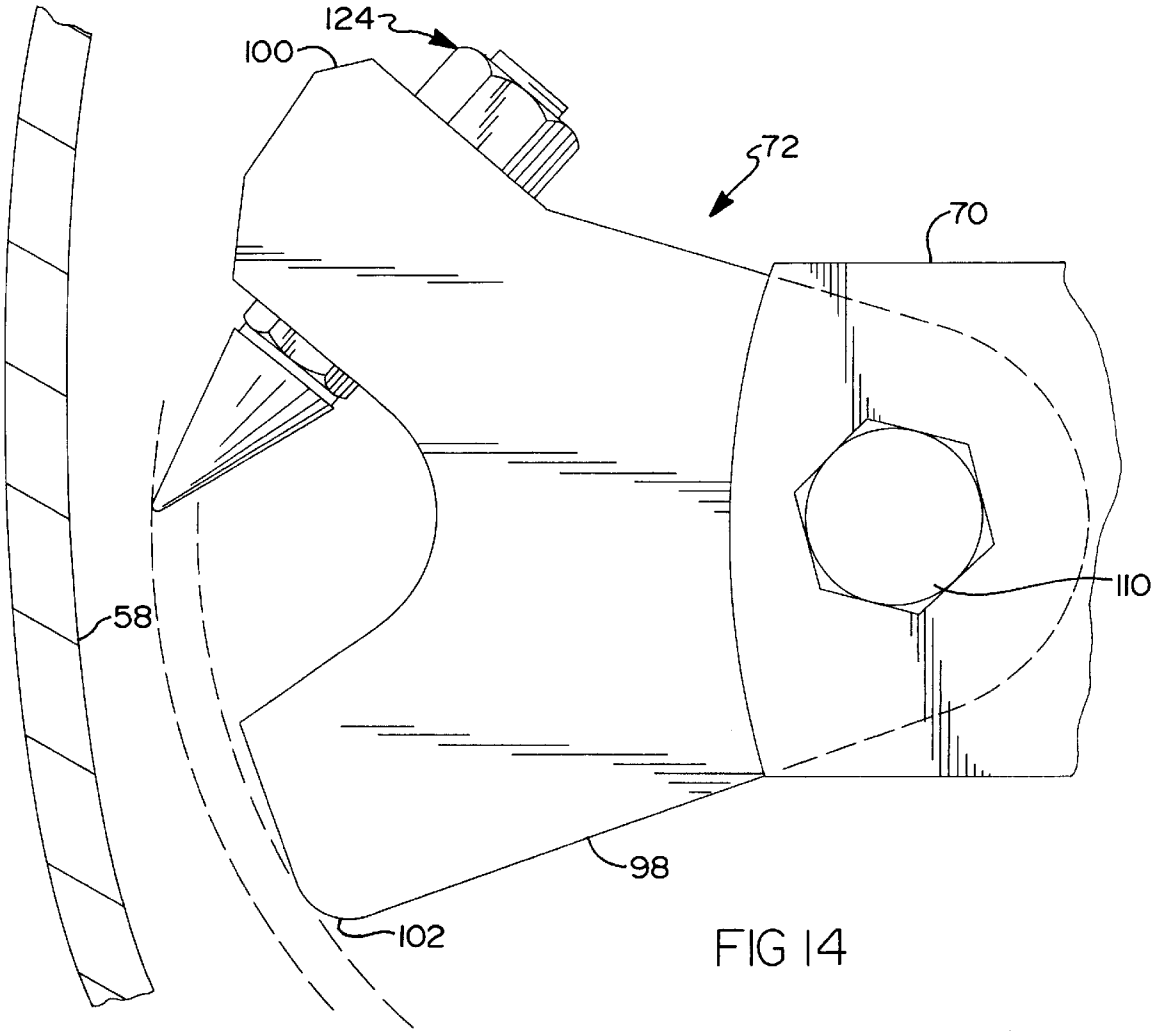
FIG. 14 is a side elevational view of the second embodiment of the processing tool assembly of FIG. 13.
Figure 15:
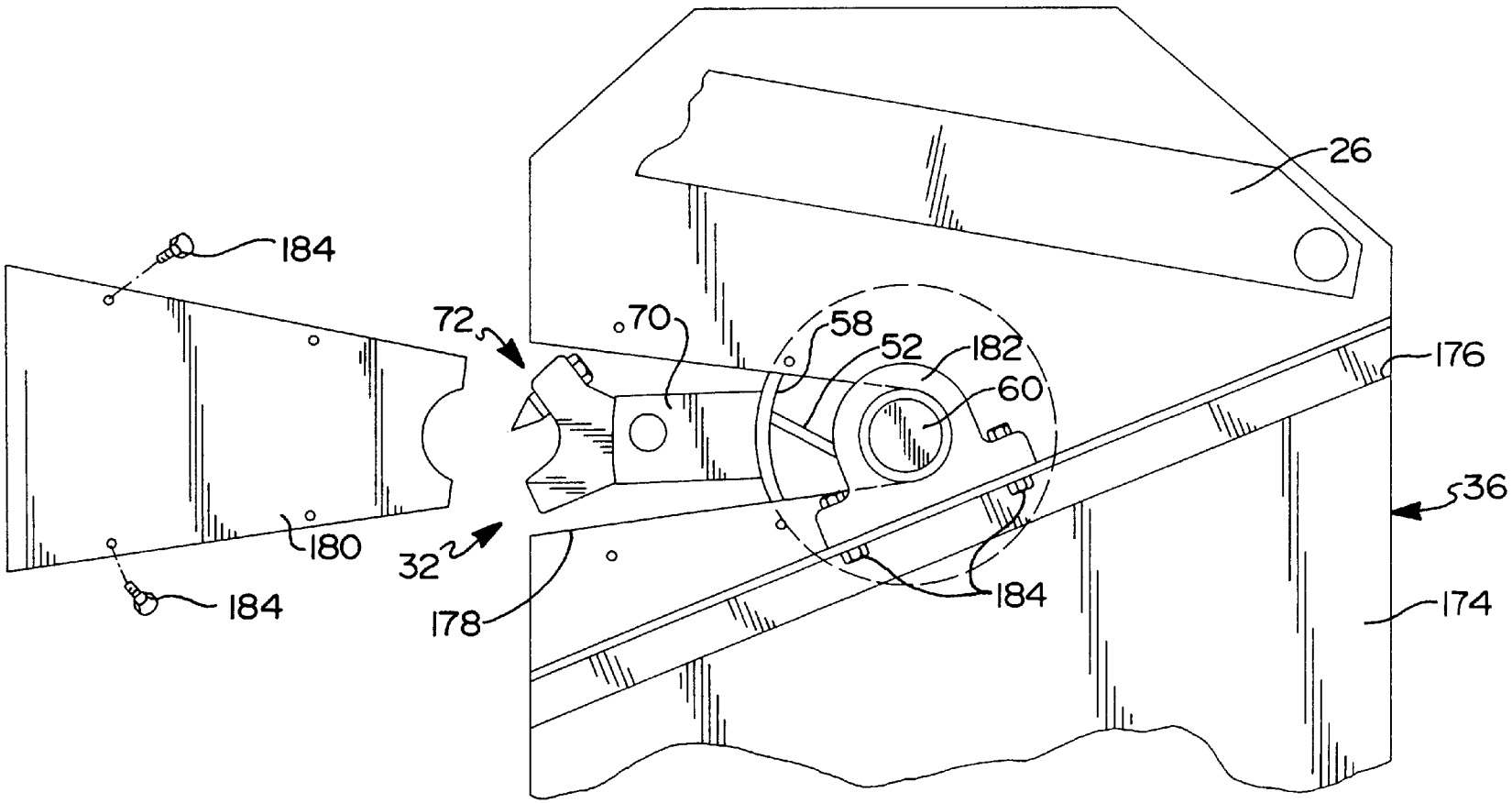
FIG. 15 is a side elevational view of a portion of the waste processing machine showing the rotor support and mounting means.

FIGS. 8–10 show a first embodiment of the processing tool element. A second embodiment is seen in FIG. 13 and still yet another embodiment is seen in FIG. 14. The different processing tool elements are all adapted for different uses. For example, the tool element 124 of the embodiments seen in FIGS. 8–10 is a chipping knife adapted to create small wood chips from the waste material. The head 128 and cutting tip 134 of the processing tool seen in FIG. 13 is adapted to both rip and cut the waste material. The pointed tip of the processing tool element seen in FIG. 14 is adapted to shred the waste material into longer strands.

As seen in FIGS. 9, 10, and 14 the second arm 102 of the tool body 98 acts as a depth guide in limiting the area of the processing tool element 124 which is exposed to the waste product being processed. The second arm 102 extends radially a distance less than the most radially remote point of the processing tool element 124 when the processing tool 72 extends orthogonally from the tube 58. The difference in the radial distance between the tip 134 and the end of the second arm 102 defines a contact area or portion of the tip 134 that will contact the material being processed. In the embodiment of the processing tool 72 seen in FIG. 14, the spacing between the tip of the cutting tool element 124 and the tip of the second arm is approximately one-half inch. As the processing tool 72 rotates with respect to the tube 58, the contact area of the cutting tip 134 will initially decrease if the tool 72 rotates counter to the rotation of the tube 58 and initially increase if the tool 72 rotates with the rotation of the tube 58. Based upon experience in testing different processing tool structures, it has been found that the rotor assembly 40 operates much more efficiently when the difference in the radial distance between the tip 134 and the end of the second arm 102 is less than one inch. However, this distance can be increased, depending upon the material being processed. The relatively small exposed contact area of the cutting tip, in combination with the position of the processing tools 72 around the perimeter of the rotor are key elements to the efficient and effective structure of the cutting system 14 according to the invention.

The second arm 102 of the tool body 98 performs two distinct functions. First, the tool body 98 is generally oriented so that the second arm 102 will make first contact with any material being processed. The second arm tends to push the material away from the tube 58 opposite the direction of the infeed system. In essence, the depth guide spaces the material a preferred distance from the rotor assembly 40. If the depth guide contacts a non-grindable or non-reducible object, the tool body 98 will be rotated counter to the rotation of the tube 58. At some point during the counter rotation of the tool body 98, the second arm 102 will extend radially a distance greater than the cutting tip 134, thereby moving the cutting tip 134 out of the path of the non-grindable object and possibly preventing damage to the cutting tip 134. On the continued rotation of the rotor, the second arm 102 will force back the material and prevent the rotor from jamming because of an overload condition.

The second function of the second arm 102 is to prevent the cutting tool element 124 from becoming embedded or caught in the material being processed 120. This is best seen in FIGS. 9 and 10. Initially, as the tool body 98 approaches the material to be ground 120, the second arm impacts the material first, which tends to push the material away from the processing tool 72. The impact of the second arm on the material may also cause the processing tool to rotate in a direction counter to the rotation of the rotor assembly 40, but the processing tool element 124, as in this illustration, may nevertheless strike the material. If the force of the processing tool is insufficient to drive the cutting tip 134 through the material, then, absent the structure of the processing tool according to the invention, the tool could become embedded in the material. This undesirable effect is avoided with the structure of the processing tool according to the invention because, as the rotor assembly 40 continues to rotate, the processing tool element 124 is effectively counter rotated relative to the rotor assembly. As the processing tool 72 is counter rotated, the terminal end of the second arm 102 is brought into contact with the material and, upon further counter rotation, effectively pries the embedded processing tool element 124 from the material, thereby preventing the jamming of the material with the rotor assembly 40. Therefore, the rotor assembly is less susceptible to jamming when the assembly encounters a non-grindable or non-reducible object. In prior waste processing machines, the waste processor would have to be shut down and the jammed material manually removed, thereby decreasing efficiency and potentially subjecting the operators to personal injury.

Although the rotor assemblies illustrated herein utilize processing tools 72 having the same type of tool element 124, it is within the scope of the invention for the rotor assembly to simultaneously mount combinations of different types of processing tools. Typically, the combination of processing tools is dictated by the type of material being processed and the desired end product. The different combinations of tools are limited only by the number of different available processing tools 100.

Preferably, as illustrated, the arm pairs 70 do not extend a sufficient distance from the tube 58 to permit the processing tools to rotate 360 degrees. The arm pairs 70 are spaced a sufficient distance so that the processing tool will rotate to a position completely within the radial length of the arm pairs before it contacts the tube 52. The advantages of the preferred arm pair 70 length are twofold. First, if the tool impacts a non-grindable object, the processing tool 72 will rotate to a position behind the end of the arm pairs and the arm pairs 60 will shield the processing tool 72 from destructive impact with the object. Second, the rotor assembly is less likely to become dynamically unstable because the processing tool 72 cannot freely counter rotate with respect to the rotation of the rotor assembly 50 after impacting an object. The distribution of the mass of the rotor assembly is limited and less likely to become unbalanced as compared to a rotor assembly in which the processing tools are free to rotate a full 360°.

Preferably, the processing tools and their associated arm pairs 70 are mounted to the outer surface of the tube 58 in a helical pattern wrapping around the tube 58. FIG. 11 is a schematic illustration of one embodiment of the helical pattern about the body of the tube. In this embodiment, the pair of arms 70 are axially spaced so that the tool elements of axially adjacent cutting tools are axially abutting or overlapping one another to provide a processing surface that effectively extends across the entire length of the tube 58. In essence, a single helical pattern of multiple processing tools 72 functions like a knife or tool extending across the entire surface of the tube 58.

The rotor assembly 40 can be formed with multiple helical patterns of cutting tools. The different helical patterns are radially spaced about the outer surface of the tube 58 to aid in dynamically stabilizing the rotor assembly 40. For each helical pattern, the axial spacing of the tools is substantially identical. For example, in a two helical pattern as illustrated in FIG. 11, the starting point for the two helical patterns are offset 180° to dynamically balance the rotor assembly, and each helical pattern will have a processing tool at substantially the same axial position of the tube 52, merely 180° offset from the other. A two-helical rotor assembly provides for two cutting tools 72 to pass through the same axial location along the tube during a single revolution of the tube 58. Similarly, in a three helical pattern, the repeating patterns will be spaced 120° apart and permit three processing tools to pass through the same axial location along the length of the tube during a single revolution of the rotor assembly.

In the second embodiment of the rotor assembly seen in FIGS. 3–7 and 16, the rotor is 60 inches wide and each helical pattern of tool elements includes 60 tool elements 72 supported on 60 pairs of arms 72. The width of the tip 134 of the tool is one inch. Therefore, each helical pattern has 60 one-inch tools which span the full 60-inch width of the rotor. Prior art cutting tool systems would align each of the processing tools along a line parallel to the longitudinal axis of the rotor. However, the rotor assembly according to the invention is a significant improvement over the prior art because the tool elements are purposely staggered about the rotor so that a relatively small number of tool elements contact a line parallel to the longitudinal axis of the rotor at any one point in time. With the 60-tool structure seen in FIG. 16, only one tool element contacts the imaginary line at any one point in time and each point along the 60-inch line is contacted at least once during each rotation of the rotor. While the preferred embodiment of staggering the tool elements is to provide a helical pattern about the rotor, any arrangement of tool elements which creates a pattern in which a reduced number of tool elements strike the line parallel to the longitudinal axis of the rotor at any one point in time is within the scope of the invention.

As noted above, the product produced by the rotor assembly according to the invention can be varied by changing the processing tool. The resulting product can also be varied by changing the spacing between the adjacent tools. For example, the 60-inch wide rotor having the 60 one-inch wide tools provided on each helical pattern can be modified by incorporating 60 one-half-inch wide processing tools to produce a partially cut, partially shredded waste product. Alternatively, some of the processing tools can be removed along the width of the rotor to provide a variable product.

In operation, the waste material is placed on the conveyor 18 of the infeed system 12 and directed toward the rotor assembly 40. The waste material contacts the feed wheel 22 and is partially crushed by the weight of the feed wheel 22. The wheel 22 further directs the waste material toward the rotor assembly 40. As a waste materials near the spinning rotor and associated cutting tools 72, a tool element 124 strikes the waste material and cuts, chips, or breaks it according to the type of tool element 124 provided. If the tool element becomes embedded in the material, it is removed therefrom by the second arm 102 as previously described.

Figure 12:
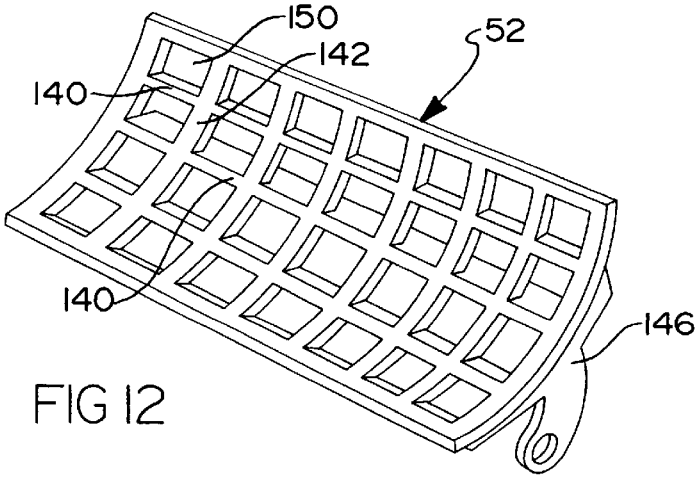
FIG. 12 is a perspective view of one of the concave screen members of FIG. 2.

Once the rotor has dislodged a piece of material from the waste product, the material with either drop down into the basin 44 or will be carried in the boundary layer created around the rotating rotor assembly 40. In the event that the cut material is carried in the boundary layer, it will be expelled from the system by passing through one of the concave screens 52, 54. As seen in FIGS. 2 and 12, the screens are defined by a plurality of axial elements 140 and a plurality of circumferential elements 142 creating screen apertures 150 therebetween. The screens 52, 54 incorporate a novel screen design to strip the cut pieces of waste material from the boundary layer of the rotor and direct the pieces into the discharge system 16. The screens 52, 54 accomplish this critical function by a unique method for forming the screen apertures 150 between the axial and circumferential elements 140, 142. Specifically, the surfaces of the axial elements 140 are cut at an acute angle with respect to a radius extending outwardly from the axis rotation of the rotor. Preferably, the screens are cut from a flat piece of steel using a plasma cutter which is oriented at an acute angle with respect to the surface of the flat plate. The preferred angle of the cutter is 32°. Once the apertures 150 are cut in the plate, the flat screen is rolled to create the concave shape. For particles that are trapped within the boundary layer, the forces of the boundary layer holding the particles close to the rotor exceed the centrifugal force acting on the particles. The angled axial elements 140 serve the function of disrupting the boundary layer so that the centrifugal force will overcome the boundary layer force causing the particles to be thrown through the screen apertures 150. The angled axial elements 140 disrupt the boundary layer so that the particles are, in effect, thrown out from the spinning rotor as a result of the centrifugal force acting on the particles.

Preferably, the screens separating the cutting system and the discharge system comprise a movable screen 52 and a fixed screen 54, the fixed screen 54 being positioned above the movable screen 52. The movable screen is pivotally mounted at a pivot point 144 to the support frame 28. A pair of brackets 146 are provided on each end of the screen and extend rearwardly therefrom. One end of a hydraulic cylinder 148 is pivotally attached to each bracket 146, and the other end of the cylinder 148 is mounted to the support frame 28.

In the event that a non-grindable object becomes entrapped in the cutting system 14, the operator can actuate the hydraulic cylinders 148 to pivot the screen downwardly, thereby creating a large opening, spanning substantially the entire width of the rotor assembly for removal of the non-grindable. Typically, the movable screen 52 is pivoted while the rotor continues to rotate, and the non-grindable will fly out the opening previously occupied by the concave screen. Once the non-grindable objects have cleared themselves from the cutting system, the operator can close the movable screen 52 and continue the processing operation. One significant advantage of the movable screen according to the invention is that it permits clearing of non-grindables from the system without stopping rotation of the rotor assembly 40. In a matter of seconds, the operator can remove the non-grindable from the cutting system and continue with the processing operation.

As seen in FIG. 1, the arcuate, upper wall 56 follows the arcuate contour of the screens 52, 56. All of these elements are spaced a prescribed distance from the outer surface of the tube 58. In the preferred embodiment, the spacing between the outermost tip of the cutting tool element 124 and the arcuate contour of the screens 52, 54 and the upper wall 56 is approximately one inch. However, this spacing can be varied depending upon the processing operation by varying the height of the cutting tools 72 or, alternatively, varying the height of the arms 70.

The preferred embodiment of the waste processing machine as seen in FIG. 2 incorporates a secondary regrind system for cutting or otherwise reducing the waste particles. As the rotor 40 rotates, some of the cut pieces of material fall into the basin 44 beneath the rotor assembly 40. Preferably, the basin 44 spans the entire width of the rotor 40 and a plurality of augers 42 are provided in the basin 44. The augers are mounted to a motor adapted to rotate the augers to push the bits of material found therein away from the bottom of the basin 44, back, up toward the spinning rotor assembly 40. As the amount of material in the basin continues to increase, eventually, the pile of bits of material will be drawn into the boundary layer of the rotating rotor assembly 40 or will be contacted directly by one of the rotating processing tools 72. The secondary anvil 50 is provided immediately at the top of the basin 44 and the bottom of the movable screen 52. The secondary anvil spans substantially the entire width of the rotor assembly and acts as a support surface for the cutting tools 72 to perform a second cutting operation on the larger bits of material. If the material, as cut a second time, is small enough to pass through the screens 52, 54, it will do so and then be discharged from the system. In the event that the cut piece is still too large to pass through the screen, it will be carried with the rotating rotor past the screens, past the arcuate upper wall 56, and be deposited back in the basin 44 for yet another reducing operation against the secondary anvil 50. Once the material has been cut and expelled from the cutting system, a conveyor 170 transports the waste products to the appropriate location for storage, shipping, or other desired process.

The secondary anvil is preferably formed from an exposed wear member 162 and a support member 164 provided behind the wear member 162. A plurality of bolts or other conventional fasteners 166 are used to securely mount the wear member 162 to the support member 164. With this structure, the wear member can be quickly and easily replaced in the result of damage by a non-grindable or as a result of wear through operation of the processing machine.

The structure of the rotor assembly 40 in combination with the regrind augers 42, secondary anvil 50, and screens 52, 54 create a waste processing system which quickly and efficiently reduces even dirty material to the desired particle size and then discharge these particles quickly and efficiently from the cutting system. The system further includes means for varying the system, allowing for customization of the processing, depending upon the application. For example, the spacing between the cutting tools and the secondary anvil 50 can be varied. The size of the screen openings can be varied, and the number, selection, and arrangement of processing tools can be varied depending upon the particular application.

FIG. 14 depicts one means for mounting the rotor assembly in the housing 36. In this embodiment, the housing 36 comprises a pair of opposed side walls 174, and a support beam 176 is provided immediately adjacent the side wall 174. The front of the housing 36 adjacent the infeed system 12 has a tapered notch 178 provided therein. The notch extends from the edge of the side wall 174 to a point adjacent the mounted position of the rotor shaft 60. The notch is selectively covered by a cover plate 180 which is secured to the side wall 174 by a plurality of conventional fasteners.

In mounting the rotor assembly 40 within the housing 36, the cover plate 180 on each side wall is removed therefrom. In addition, the conveyor 18 is moved away from the housing and the feed wheel 22 supported by the horizontal support arm 26 is raised away from the inlet opening 32. Next, the rotor, supported by a suitable crane mechanism, is hoisted and slid into the housing 38 so that the rotor shaft 60 is received in the tapered notch 178 of each side wall 174. Preferably, the support bearings 182 on the shaft are positioned on the outside of the side walls 174. The rotor assembly 40 is moved rearwardly in the notch until the bearing supports 182 are aligned with appropriate mounting apertures provided on the support beam 176. Conventional fasteners 184 such as bolts are used to secure the bearing supports 182 to the support beam 176. After the rotor assembly 40 is secured to the support beam 176, the cover plate 180 is replaced, thereby substantially enclosing the side of the housing 36. Finally, the conveyor 18 can be repositioned and the feed wheel 22 can be lowered to the operative position. The tapered notch and support beam mounting structure according to this embodiment allows for fast and efficient mounting of the rotor assembly in the operative position despite the close tolerances between the rotor assembly 40 and the remainder of the housing 36, such as the arcuate, upper wall 56 (FIG. 2).

Although the rotor assembly 40 is described and illustrated in combination with the infeed system 12 and discharge system 16, it should be noted that the rotor assembly 40 can function without either the infeed system 12 or the discharge system 16. For example, it is contemplated that the rotor assembly 40 can be used in large scale municipal waste systems in which a vehicle or other transport loaded with waste material can back directly adjacent to the rotor assembly 40 and dump its waste material directly into the rotor assembly 40 for processing and removal to a waste storage area. Likewise, it is also contemplated that the rotor assembly 40 can be used in a similar manner in a landfill where the process material is directed into the landfill.

The rotor assembly has many advantages over prior art rotor assemblies. Most importantly, the rotor assembly according to the invention is scalable from a rotor assembly having a very small diameter to a rotor assembly having a diameter of tens of feet. All that is required to scale the rotor assembly 40 is to select a tube 58 with the desired diameter and accordingly alter the size of the jig 74 and braces 62. The length of the arm pairs 70 and the size of the processing tool 72 remain substantially the same size regardless of the diameter of the rotor assembly.

Moreover, for a given diameter rotor assembly, the rotor assembly 40 has a relatively low mass and inertia as compared to prior art rotor assemblies. The relative low mass and inertia permit the rotor assembly 40 can be turned by a substantially smaller power source for a given diameter rotor assembly. As the diameter increases to tens of feet, most current rotor assemblies would have a mass and inertia that is too great to be turned at the desired speed by a practical power source. Therefore, unlike prior art rotor assemblies, whose mass and inertia ultimately placed an upper limit on the diameter of the rotor assembly, the rotor assembly 40 can be made in sufficiently larger diameters with much less power requirements and effectively not having an upper limit.

Reasonable variation and modification are possible within the spirit of the foregoing specification and drawings without departing from the scope of the invention.

What is claimed is:

1. A waste processing machine for reducing waste material comprising:

a rotor assembly having a rotor rotatable about an axis and a plurality of reducing members mounted to said rotor to reduce the waste material; and an infeed conveyor disposed adjacent said rotor assembly and having an infeed end extending longitudinally to a discharge end, said infeed end and said discharge end being positioned on an infeed side of said rotor, said discharge end being positioned longitudinally on an infeed side of said rotor and vertically a distance at a point at or below the axis of said rotor so that a primary reducing operation of the waste material takes place beyond and longitudinally forward of said discharge end of said infeed conveyor on the infeed side of said rotor, said conveyor being the sole means of support for the waste material and acting as a primary anvil for said reducing members to perform the primary reducing operation on the waste material.

2. A waste processing machine for reducing dirty waste material having non-grindables therein comprising:

a rotor assembly having a rotor rotatable about an axis and a plurality of reducing members pivotally mounted to said rotor to reduce the dirty waste material, and reducing members being staggered in a helical pattern about the periphery of the rotor so that only a limited number of reducing members are adapted to pass through a line parallel to the axis of rotation of the rotor at any one point in time; and an infeed conveyor disposed adjacent said rotor assembly and having an infeed end extending longitudinally to a discharge end, said infeed end and said discharge end being positioned on an infeed side of said rotor, said discharge end being positioned longitudinally on the infeed side of said rotor and vertically a distance between a point at or below the axis of said rotor so that a primary cutting operation of the dirty waste material takes place beyond and longitudinally forward of said discharge end of said infeed conveyor on the infeed side of said rotor, said conveyor being adapted to be the sole means of support for the dirty waste material and acting as a primary anvil for said reducing members to perform the primary cutting operation on the dirty waste material.

3. A waste processing machine for reducing wood product contaminated with non-regrindables comprising:

rotor means forming a rotor rotatable about an axis;

reducing means mounted to said rotor means for reducing the wood product as said rotor means rotates; and infeed means disposed adjacent said rotor means and having an infeed end extending longitudinally to a discharge end, said infeed end and said discharge end being positioned on an infeed side of said rotor means, said discharge end being positioned longitudinally on the infeed side of said rotor means and vertically a distance at a point at or below the axis of said rotor means for allowing a primary reducing operation of the wood product to take place beyond and longitudinally forward of said discharge end of said infeed means on the infeed side of said rotor means and for solely supporting the wood product contaminated with non-regrindables and for acting as an anvil for said reducing means for performing the primary reducing operation on the wood product.

* * * * *